US005655393A

United States Patent [19]

Kuo et al.

[11] Patent Number: 5,655,393

[45] Date of Patent: Aug. 12, 1997

[54] DOOR LOCK SET WITH SIMULTANEOUSLY RETRACTABLE DEADBOLT AND LATCH

[75] Inventors: Ching-Chuan Kuo; Lan-Kun Don, both of Chia-Yi Hsien, Taiwan

[73] Assignee: Tong-Lung Metal Industry Co., Ltd., Taiwan

[21] Appl. No.: 399,817

[22] Filed: Mar. 7, 1995

[51] Int. Cl.[6] ..... E05B 65/10

[52] U.S. Cl. ..... 70/107; 70/92

[58] Field of Search ..... 70/92, 107–111, 70/134, DIG. 42; 292/21, 34–37, 40, 336.3, 336.5, DIG. 37, DIG. 62

[56] References Cited

U.S. PATENT DOCUMENTS

| | | | |
|---|---|---|---|
| 3,390,558 | 7/1968 | Tornoe et al. | 70/107 |
| 3,981,164 | 9/1976 | Balducci | 70/92 |
| 4,011,741 | 3/1977 | Nolin | 70/107 |
| 4,127,016 | 11/1978 | Ibsen | 70/92 |
| 4,145,900 | 3/1979 | Ohno | 70/92 |
| 4,156,541 | 5/1979 | Babb, Jr. et al. | 70/92 X |
| 4,363,231 | 12/1982 | Kaveney, Jr. | 70/92 X |
| 4,418,552 | 12/1983 | Nolin | 70/92 X |
| 4,709,950 | 12/1987 | Zortman | 70/92 X |
| 4,763,934 | 8/1988 | Kaveney, Jr. | 70/92 X |
| 4,838,053 | 6/1989 | Shen | 70/92 |
| 4,864,835 | 9/1989 | Wartian | 70/107 |
| 4,995,248 | 2/1991 | Liu | 70/107 |
| 5,077,992 | 1/1992 | Su | 70/107 |

FOREIGN PATENT DOCUMENTS

| | | | |
|---|---|---|---|
| 578847 | 6/1959 | Canada | 70/92 |

*Primary Examiner*—Suzanne Dino
*Attorney, Agent, or Firm*—Ladas & Parry

[57] ABSTRACT

A door lock set includes a housing set to be mounted on an outer side of a door, an outside rotary lock unit mounted on the housing set and provided with a rotatable deadbolt spindle, a deadbolt assembly having a deadbolt and a bolt driving mechanism operatively driven by the deadbolt spindle for extending the deadbolt outwardly to lock the door, an outside lever mechanism mounted on the housing set and provided with a rotatable latch spindle, a latch assembly having a latch and a latch driving mechanism operatively driven by the latch spindle for extending the latch outwardly to lock the door, and a link assembly. The link assembly includes a pull shaft connected operably to the outside lever mechanism so as to drive rotatably the latch spindle, a coupling shaft connected pivotally to the pull shaft and mounted pivotally to the housing set, and a driving cam connected operably to the outside rotary lock unit for co-rotation with the deadbolt spindle. The driving cam contacts the coupling shaft and drives the coupling shaft to pivot so as to pull the pull shaft and enable the pull shaft to drive rotatably the latch spindle in order to result in simultaneous retraction of the deadbolt and the latch when the outside rotary lock unit is operated to rotate the deadbolt spindle.

7 Claims, 7 Drawing Sheets

DOOR LOCK SET WITH SIMULTANEOUSLY RETRACTABLE DEADBOLT AND LATCH

BACKGROUND OF THE INVENTION

1. Field of the Invention

The invention relates to a door lock set, more particularly to a door lock set with simultaneously retractable deadbolt and latch.

2. Description of the Related Art

U.S. Pat. No. 5,077,992 discloses a door lock set which comprises a latch with a latch driving mechanism operatively driven by an inside knob that is fixed on a spindle of the latch driving mechanism and that is disposed on an inner side of a door for extending the latch outwardly to lock the door, a deadbolt with a bolt driving mechanism operatively driven by an inside thumbturn that is fixed on a spindle of the bolt driving mechanism and that is disposed on the inner side of the door for extending the deadbolt outwardly to lock the door, a driving cam secured on the spindle of the latch driving mechanism, a follower cam secured on the spindle of the bolt driving mechanism, and a linking rod having a first end portion engaging the driving cam and a second end portion engaging the follower cam. The driving cam, the follower cam and the linking rod permit simultaneous retracting of the deadbolt and the latch when the inside knob is operated.

The latch driving mechanism is further operatively driven by an outside lever mechanism that is fixed on the spindle of the latch driving mechanism and that is disposed on an outer side of the door, while the bolt driving mechanism is further operatively driven by an outside key-operated lock unit that is fixed on the spindle of the bolt driving mechanism and that is similarly disposed on the outer side of the door. The door is opened from the outside by first inserting a key into the outside key-operated lock unit so as to unlock the latter and retract the deadbolt, and then by depressing the outside lever mechanism so as to retract the latch.

Although the above described door lock set can ease opening of a door from the inside to facilitate emergency escape from a room in case of a fire, it does not facilitate opening of the door from the outside in case of an emergency.

SUMMARY OF THE INVENTION

Therefore, the object of the present invention is to provide a door lock set with simultaneously retractable deadbolt and latch which facilitates opening of a door from the outside.

Accordingly, a door lock set of the present invention comprises: a housing set to be mounted on an outer side of a door; an outside rotary lock unit mounted on the housing set and provided with a rotatable deadbolt spindle; a deadbolt assembly including a deadbolt and a bolt driving mechanism operatively driven by the deadbolt spindle for extending the deadbolt outwardly to lock the door; an outside lever mechanism mounted on the housing set and provided with a rotatable latch spindle; a latch assembly including a latch and a latch driving mechanism operatively driven by the latch spindle for extending the latch outwardly to lock the door; and a link assembly.

The link assembly includes: a pull shaft having a first end connected operably to the outside lever mechanism so as to drive rotatably the latch spindle, and a second end; a coupling shaft having a first end connected pivotally to the second end of the pull shaft, an intermediate portion mounted pivotally to the housing set, and a second end; and a driving cam connected operably to the outside rotary lock unit for co-rotation with the deadbolt spindle.

The driving cam has a camming portion which contacts the second end of the coupling shaft and drives the coupling shaft to pivot so as to pull the pull shaft and enable the pull shaft to drive rotatably the latch spindle in order to result in simultaneous retraction of the deadbolt and the latch when the outside rotary lock unit is operated to rotate the deadbolt spindle.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
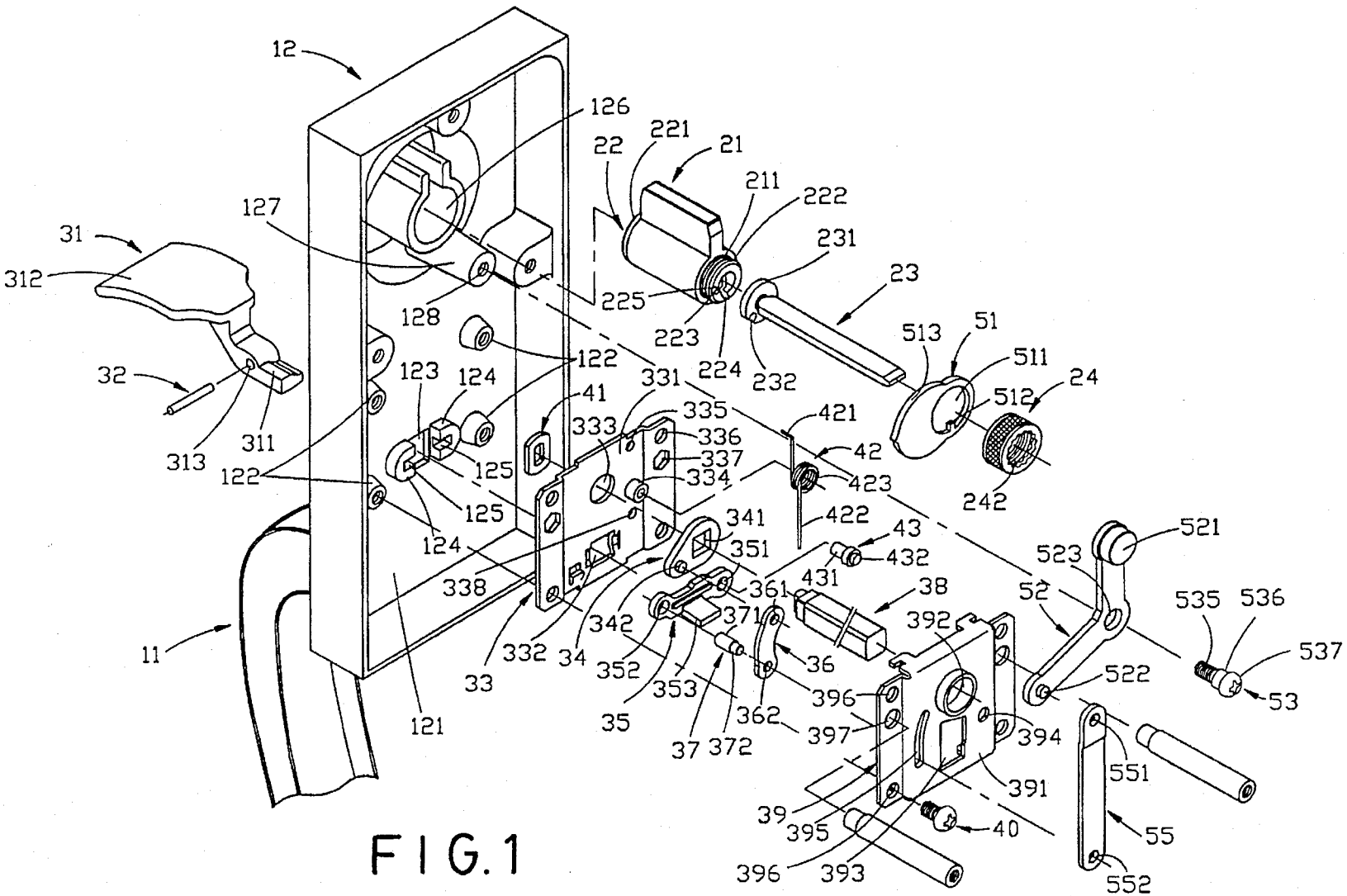
FIG. 1 is a fragmentary exploded view of the first preferred embodiment of a door lock set according to the present invention.

Before the present invention is described in greater detail, it should be noted that like elements are indicated by the same reference numerals throughout the disclosure.

Figure 2:
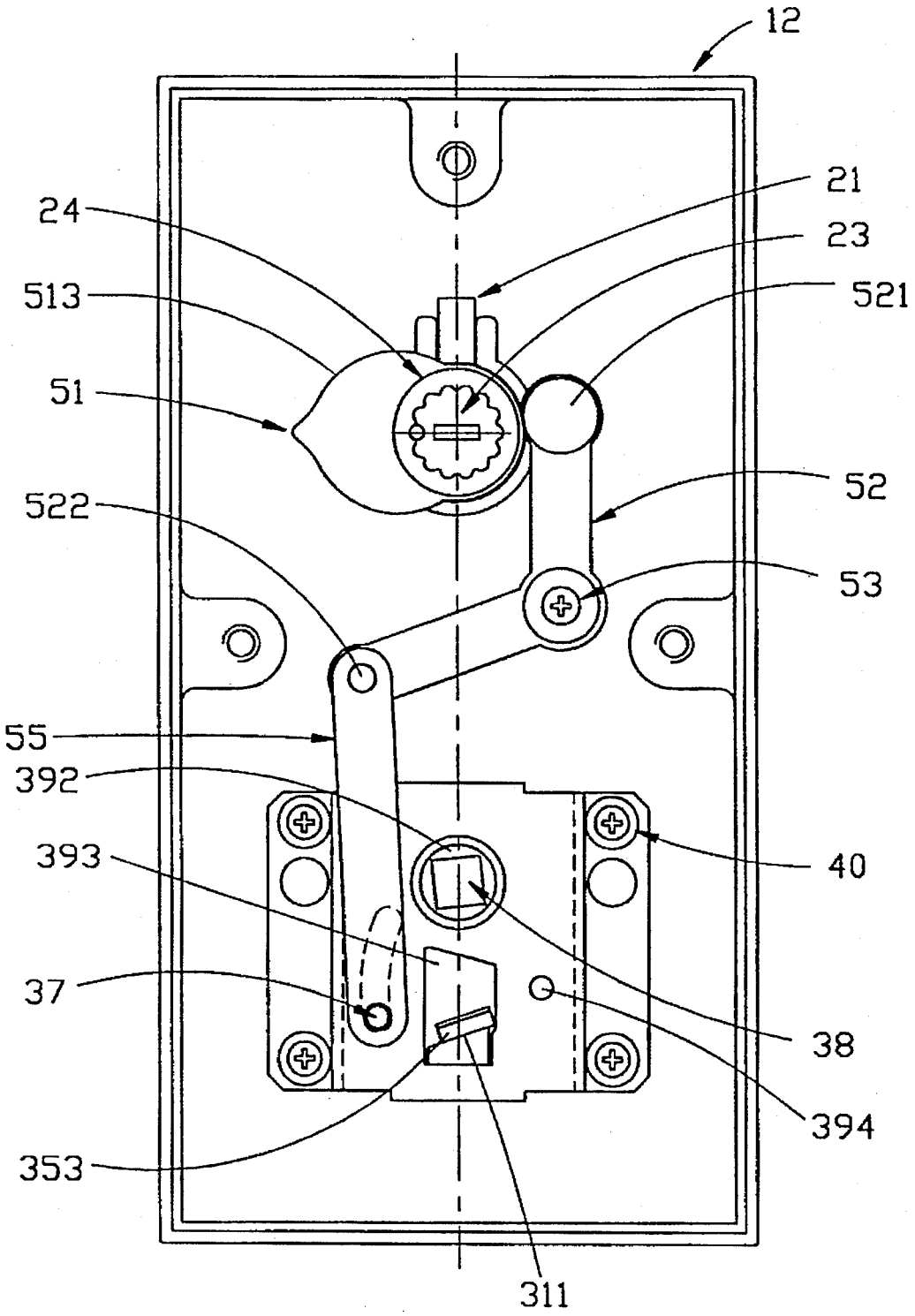
FIG. 2 is a schematic plan view which illustrates assembly of the first preferred embodiment.
Figure 3:
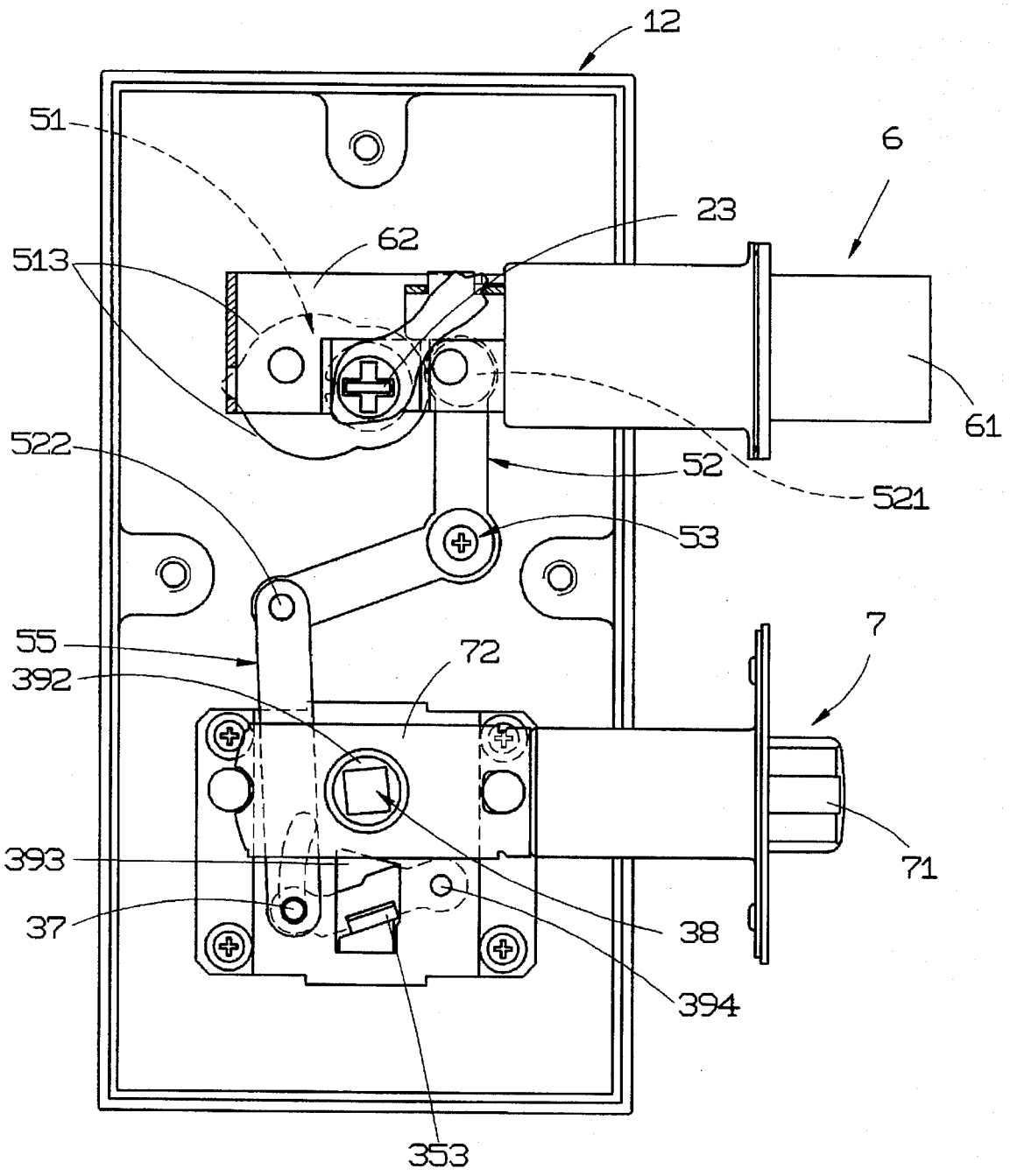
FIG. 3 is a schematic plan view which illustrates the first preferred embodiment when both the deadbolt and the latch are extended.

Referring to FIGS. 1 to 3, the first preferred embodiment of a door lock set according to the present invention is shown to comprise a housing set, an outside rotary lock unit, an outside lever mechanism, a link assembly, a deadbolt assembly 6 and a latch assembly 7.

The housing set includes a handle 11 and an escutcheon plate 12 to be mounted on an outer side of a door (not shown).

The outside rotary lock unit is preferably a key-operated lock unit and includes a lock shell 21, a rotatable core 22, a deadbolt spindle 23 and a lock nut 24.

The outside lever mechanism includes a lever 31, a pivot pin 32, a first retaining plate 33, a spindle actuator 34, a drive plate 35, a connecting plate 36, a positioning pin 37, a latch spindle 38, a second retaining plate 39, mounting screws 40, a mounting piece 41, a torsion spring 42 and a mounting knob 43. The link assembly includes a driving cam 51, a coupling shaft 52, a mounting screw 53 and a pull shaft 55.

The housing set, the outside rotary lock unit and the outside lever mechanism are generally conventional in construction and will be described briefly herein.

The handle 11 of the housing set has two ends, one of which is secured to the escutcheon plate 12 while the other one of which is to be mounted on the outer side of the door.

The escutcheon plate 12 is formed as a hollow rectangular casing with a base plate 121. The base plate 121 is formed with four screw sockets 122 on an inner side for mounting the first and second retaining plates 33, 39 thereon, a through-hole 123 between the screw sockets 122 to permit extension of one end of the lever 31 therethrough, and a pair of retaining projections 124 at the inner side on two sides of the through-hole 123. The retaining projections 124 are formed with aligned pin grooves 125 for retaining two ends of the pivot pin 32 therein. The base plate 121 is further formed with a retaining hole 126 above the through-hole 123 for receiving the lock shell 21, and a mounting stub 127 on the inner side between the through-hole 123 and the retaining hole 126. The mounting stub 127 is formed with an axial threaded hole 128 for securing the link assembly thereon.

The lock shell 21 of the outside rotary lock unit is formed with an axial through hole 211 to permit extension of the rotatable core 22 therethrough. The rotatable core 22 is a cylindrical member with front and rear end portions that extend out of the lock shell 21. The front end portion of the rotatable core 22 is formed with a radial limit flange 221, while the rear end portion thereof is formed with an external screw thread 222 for engaging the lock nut 24. The rear end portion of the rotatable core 22 has an end face which is formed with a blind bore 225 that receives a spring-loaded tumbler 223 therein. The tumbler 223 engages the deadbolt spindle 23 to permit rotation of the latter therewith so as to drive the deadbolt assembly 6. The rotatable core 22 is further formed with an axially extending keyway 224. A key (not shown) is insertable into the keyway 224 to drive rotatably the rotatable core 22.

The deadbolt spindle 23 is formed as a strip with one end that is provided with a circular connecting plate 231. The connecting plate 231 has a notch 232 which engages the tumbler 223 of the rotatable core 22. The other end of the deadbolt spindle 23 drives operably the deadbolt assembly 6 in a known manner.

The lock nut 24 is an annular member which permits extension of the deadbolt spindle 23 therethrough and is formed with an internal screw thread 242 for engaging the external screw thread 222 on the rear end portion of the rotatable core 22 and for securing the driving cam 51 of the link assembly to the rotatable core 22.

The lever 31 of the outside lever mechanism has a rear section formed with a thin driving portion 311 that is extendible into the through-hole 123 of the base plate 121 of the escutcheon plate 12, a front section formed with a wide operating portion 312 disposed outside the escutcheon plate 12, and an intermediate section that is formed with a pin hole 313 to permit extension of the pivot pin 32 therethrough. The two ends of the pivot pin 32 are received in the pin grooves 125 of the retaining projections 124 of the escutcheon plate 12 to mount pivotally the lever 31 to the latter.

The first retaining plate 33 is a generally rectangular plate 331 that is to be disposed on the screw sockets 122 of the base plate 121 and that is formed with a through-hole 332 aligned with the through-hole 123 of the base plate 121 and a spindle hole 333 above the through-hole 332 to permit the latch spindle 38 to extend rotatably therethrough. The rectangular plate 331 is further provided with a mounting stub 334 on an inner side opposite to the escutcheon plate 12 between the through-hole 332 and the spindle hole 333, and two holes 335, 338 located above and below the mounting stub 334. The torsion spring 42 is sleeved on the mounting stub 334. The periphery of the rectangular plate 331 is formed with four mounting holes 336 which are aligned with the screw sockets 122 of the escutcheon plate 12, and two screw holes 337. The mounting holes 336 permit extension of the mounting screws 40 therethrough.

The spindle actuator 34 is a plate-like member to be disposed adjacent to the first retaining plate 33 and has one end formed with a polygonal spindle hole 341 for engaging the latch spindle 38, and an opposite end formed with a rearward projection 342 for engaging the connecting plate 36.

The drive plate 35 is an elongated member with opposite ends formed respectively with first and second holes 351, 352. The mounting knob 43 has one end 431 that extends through the first hole 351 and the hole 338 in the first retaining plate 33 to mount pivotally the drive plate 35 to the first retaining plate 33. The positioning pin 37 has a first end 371 that extends through the second hole 352 and a second end 372 that is mounted to the connecting plate 36 to join the connecting plate 36 to the drive plate 35. The drive plate 35 further has a rearwardly projecting arm 353 positioned above the driving portion 311 of the lever 31. Thus, operation of the lever 31 will cause corresponding movement of the drive plate 35.

The connecting plate 36 is an elongated member with opposite ends formed respectively with first and second holes 361, 362. The first hole 361 engages the rearward projection 342 of the spindle actuator 34. The second end 372 of the positioning pin 37 extends through the second hole 362 to interconnect the connecting plate 36 and the drive plate 35 and extends through the second retaining plate 39.

The latch spindle 38 is a polygonal shaft and has one end that extends through the spindle holes 341, 333 in the spindle actuator 34 and the first retaining plate 33 and that is secured to the mounting piece 41, and an opposite end that extends through the second retaining plate 39 and that drives operably the latch assembly 7 in a known manner.

The second retaining plate 39 is a generally rectangular plate 391 that cooperates with the first retaining plate 33 to confine the spindle actuator 34, the drive plate 35 and the connecting plate 36 therebetween. The rectangular plate 391 is formed with a spindle hole 392 aligned with the spindle hole 333 of the first retaining plate 33 to permit extension of the latch spindle 38 therethrough, and a through-hole 393 aligned with the through-hole 332 of the first retaining plate 33 to permit extension of the arm 353 of the drive plate 35 therethrough. The rectangular plate 391 is further provided with a hole 394 aligned with the hole 338 in the first retaining plate 33 to retain the other end 432 of the mounting knob 43 therein, and a curved slot 395 that permits extension of the second end 372 of the positioning pin 37 therethrough. The periphery of the rectangular plate 391 is similarly formed with four mounting holes 396 and two screw holes 397 which are aligned with the mounting holes 336 and screw holes 337 of the first retaining plate 33. The mounting screws 40 extend through the mounting holes 336, 396 to secure the first and second retaining plates 33, 39 on the escutcheon plate 12.

The torsion spring 42 has a first end 421 secured to the hole 335 in the first retaining plate 33 and a second end 422 abutting the arm 353 of the drive plate 35. The intermediate portion 423 of the torsion spring 42 is formed as a series of concentric turns and is sleeved on the mounting stub 334 of the first retaining plate 33. The torsion spring 42 provides a restoring force to the drive plate 35.

The driving cam 51 of the link assembly is disposed adjacent to the rear end of the lock shell 21 and is formed with a through-hole 511 that permits extension of the rear end portion of the rotatable core 22 therethrough. The periphery confining the through-hole 511 is formed with a key projection 512 that engages the keyway 224 of the rotatable core 22, thereby connecting the driving cam 51 operably to the outside rotary lock unit for co-rotation with the deadbolt spindle 23. The driving cam 51 further has a camming portion 513 for causing pivoting movement of the coupling shaft 52.

The coupling shaft 52 is a generally V-shaped member having one end formed with a driven stub 521 to be driven by the camming portion 513 of the driving cam 51, an opposite end formed with a connecting stub 522 for connection with the pull shaft 55, and an intermediate portion formed with a through-hole 523 that permits extension of the mounting screw 53 therethrough.

The mounting screw 53 has a threaded shank portion 535, a head portion 537 and a support shank portion 536 between the threaded shank portion 535 and the head portion 537. The diameter of the support shank portion 536 is larger than that of the threaded shank portion 535 but is smaller than that of the head portion 537. The threaded shank portion 535 extends through the through-hole 523 of the coupling shaft 52 and engages threadedly the threaded hole 128 of the mounting stub 127 of the escutcheon plate 12, while the support shank portion 536 supports rotatably the coupling shaft 52 thereon, thereby mounting pivotally the coupling shaft on the escutcheon plate 12.

The pull shaft 55 is formed as an elongated strip with opposite ends formed respectively with first and second mounting holes 551, 552. The first mounting hole 551 permits extension of the connecting stub 522 of the coupling shaft 52 therethrough to interconnect pivotally the pull shaft 55 and the coupling shaft 52, while the second mounting hole 552 permits extension of the second end 372 of the positioning pin therethrough to interconnect pivotally the pull shaft 55 and the drive plate 35.

Figure 4:
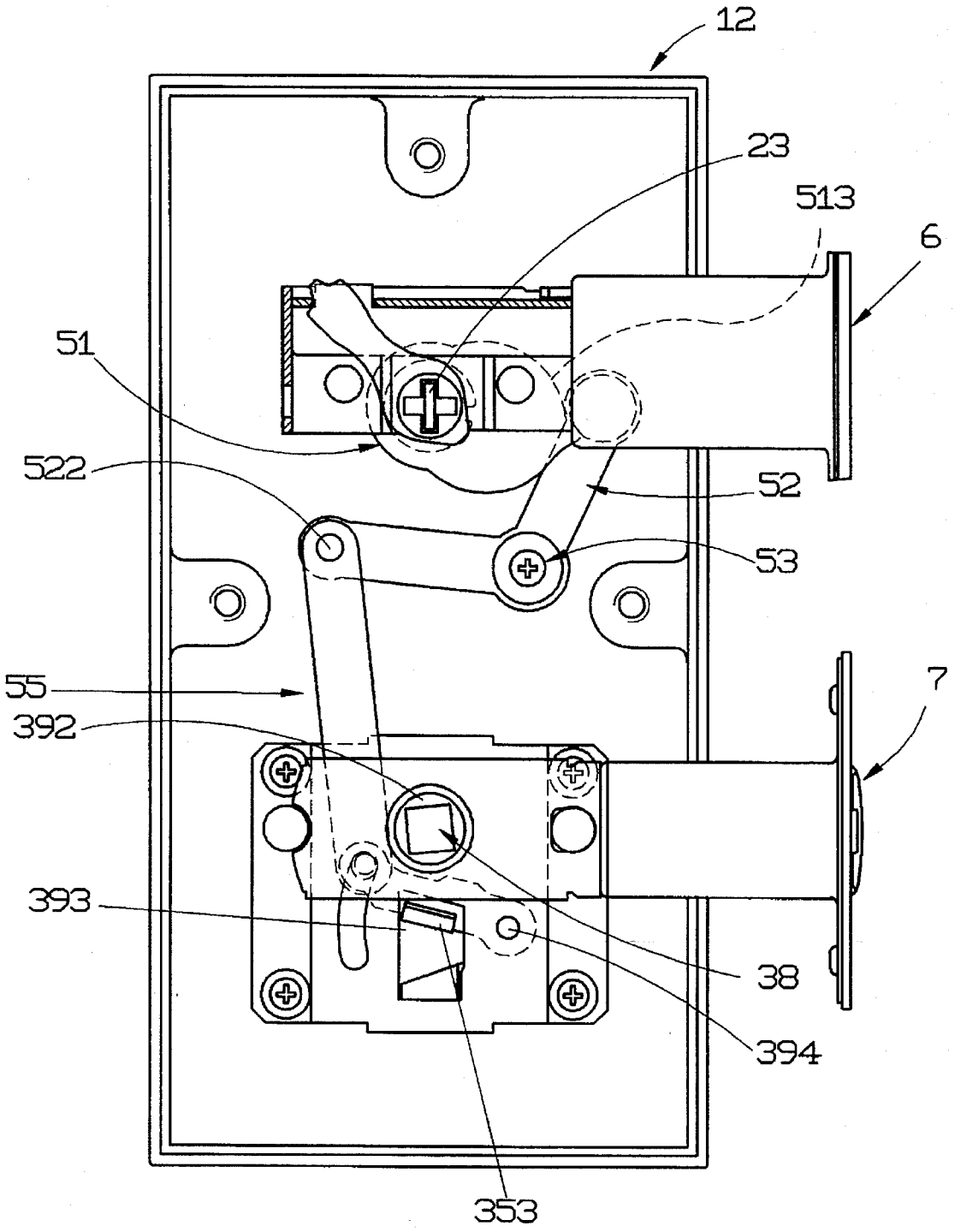
FIG. 4 is a schematic plan view which illustrates the first preferred embodiment when both the deadbolt and the latch are retracted.

Referring to FIGS. 3 and 4, the deadbolt assembly 6 is conventional in construction and includes a deadbolt 61 and a bolt driving mechanism 62 operatively driven by the deadbolt spindle 23 for extending the deadbolt 61 outwardly to lock the door.

The latch assembly 7 is also conventional in construction and includes a latch 71 with a latch driving mechanism 72 operatively driven by the latch spindle 38 for extending the latch 71 outwardly to lock the door.

In use, when the deadbolt 61 and the latch 71 are initially in their extended positions so as to lock the door, as shown in FIG. 3, a key (not shown) can be inserted into the keyway 224 of the rotatable core 22 so as to drive rotatably the latter. The deadbolt spindle 23 of the outside rotary lock unit rotates with the rotatable core 22 to cause retraction of the deadbolt 61 in a known manner. At the same time, the rotatable core 22 drives the driving cam 51 to rotate therewith, thereby causing the camming portion 513 of the driving cam 51 to contact the driven stub 521 and drive the coupling shaft 52 to pivot about the mounting screw 53. The coupling shaft 52 pulls the pull shaft 55 to pull correspondingly the positioning pin 37 of the outside lever mechanism. Movement of the positioning pin 37 results in corresponding movement of the connecting plate 36 and the spindle actuator 34, thereby resulting in rotation of the latch spindle 38 to cause retraction of the latch 71 in a known manner, as shown in FIG. 4.

Accordingly, it has thus been shown that the door lock set of the present invention facilitates opening of the door from the outside in case of an emergency since operation of the outside rotary lock unit to retract the deadbolt 61 will cause simultaneous retraction of the latch 71.

Figure 5:
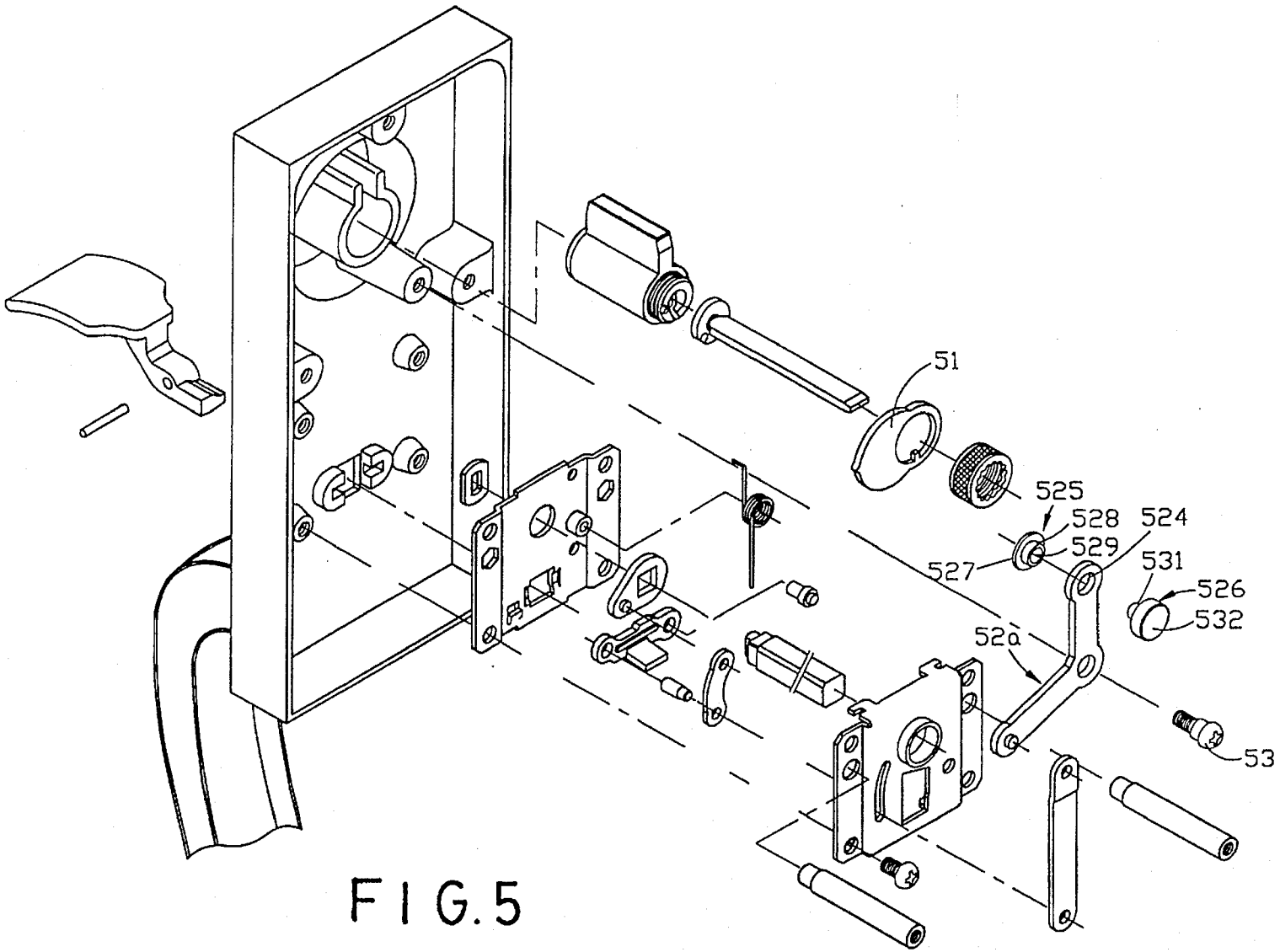
FIG. 5 is a fragmentary exploded view of the second preferred embodiment of a door lock set according to the present invention.

FIG. 5 illustrates the second preferred embodiment of a door lock set according to the present invention. The second preferred embodiment is substantially similar to the first preferred embodiment, the main difference residing in the construction of the coupling shaft. In this embodiment, the coupling shaft **52*a* is not formed with a driven stub at one end. Instead, the coupling shaft 52*a* is provided with a retaining hole 524 and a rotatable roller set constituted by a rotatable ring 525 and a sleeve ring 526** at this end.

The rotatable ring 525 includes a base plate 527 and an annular support 528 projecting from one side of the base plate 527. The annular support 528 confines a through-hole 529 and extends rotatably through the retaining hole 524 of the coupling shaft **52*a***.

The sleeve ring 526 has coaxial first and second cylindrical ring portions 531, 532, the diameter of the second cylindrical ring portion 532 being larger than that of the first cylindrical ring portion 531. The first cylindrical portion 531 extends through the through-hole 529 of the rotatable ring 525 and rivets the rotatable ring 525 onto the coupling shaft **52*a***.

In use, operation of the outside rotary lock unit with the use of a key (not shown) will cause the driving cam 51 to contact the sleeve ring 526, thereby causing free rotation of the sleeve ring 526 and pivoting of the coupling shaft **52*a* about the mounting screw 53. The modified structure of the coupling shaft 52*a*** permits a reduction in the driving force applied by the link assembly onto the outside lever mechanism when the key is operated.

Figure 6:
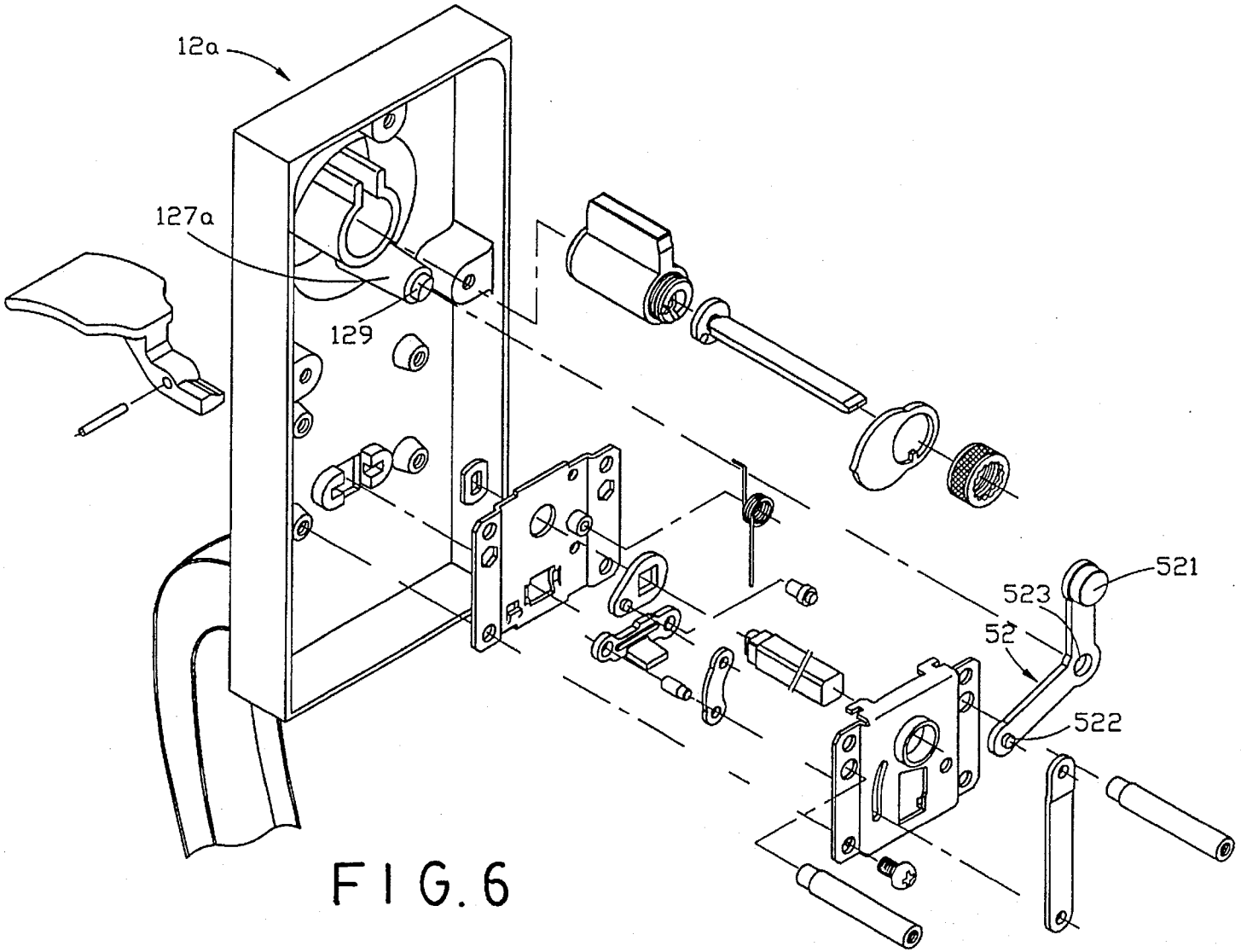
FIG. 6 is a fragmentary exploded view of the third preferred embodiment of a door lock set according to the present invention.

FIG. 6 illustrates the third preferred embodiment of a door lock set according to the present invention. The third preferred embodiment is substantially similar to the first preferred embodiment, the main difference residing in the mounting of the coupling shaft on the escutcheon plate. In this embodiment, the mounting stub **127*a* of the escutcheon plate 12*a* is not formed with an axial threaded hole. Instead, the mounting stub 127*a* is formed with an axial pivot support 129 which extends through the through-hole 523 of the coupling shaft 52 to support rotatably the same. A cover plate (not shown) secured to the escutcheon plate 12*a* prevents removal of the coupling shaft 52** from the latter.

Figure 7:
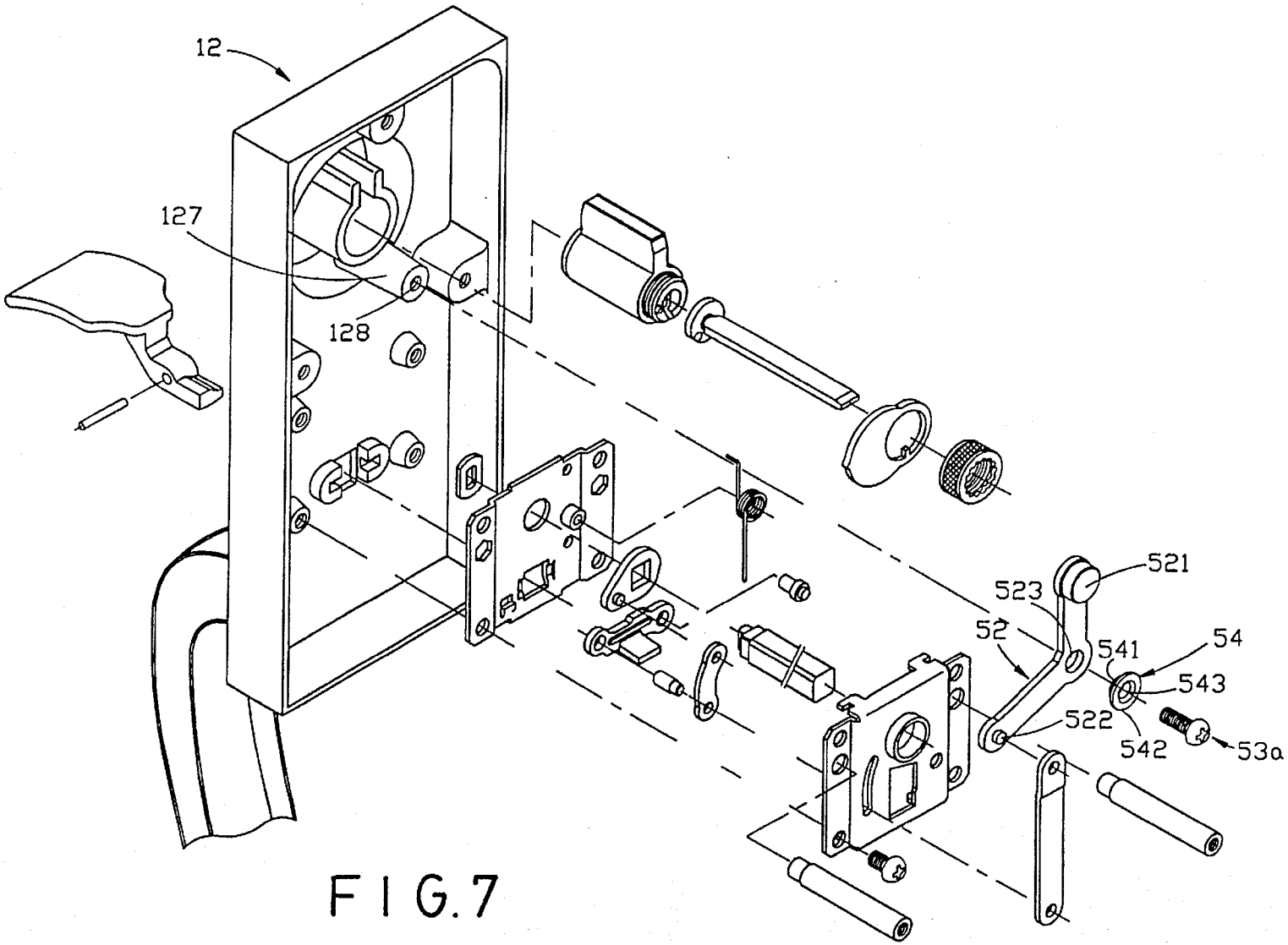
FIG. 7 is a fragmentary exploded view of the fourth preferred embodiment of a door lock set according to the present invention.

FIG. 7 illustrates the fourth preferred embodiment of a door lock set according to the present invention. The fourth preferred embodiment is substantially similar to the first preferred embodiment. As with the third preferred embodiment, the main difference between the first and fourth preferred embodiment resides in the mounting of the coupling shaft on the escutcheon plate. In this embodiment, the mounting screw **53*a* is not formed with a support shank portion. Instead, a support ring 54 is inserted through the through-hole 523 of the coupling shaft 52 and is formed with a through-hole 543 to permit sleeving of the coupling shaft 52 on the mounting screw 53*a* to support rotatably the coupling shaft 52 on the mounting screw 53*a*. Preferably, the support ring 54 has a first portion 541 longer than a thickness of the coupling shaft 52 and a second portion 542 with a diameter greater than that of the first portion 541. As with the first preferred embodiment, the mounting screw 53*a* engages threadedly the threaded hole 128 of the mounting stub 127 of the escutcheon plate 12 to mount pivotally the coupling shaft 52 onto the escutcheon plate 12**.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A door lock set comprising:

a housing set to be mounted on an outer side of a door;

an outside rotary lock unit mounted on said housing set and provided with a rotatable deadbolt spindle;

a deadbolt assembly including a deadbolt and a bolt driving mechanism operatively driven by said deadbolt spindle for extending said deadbolt outwardly to lock the door;

an outside lever mechanism mounted on said housing set, said outside lever mechanism including a rotatable latch spindle, a lever which has an operating portion disposed outside said housing set, an intermediate section mounted pivotally to said housing set about a horizontal axis, and a driving portion that extends into said housing sets, and coupling means for coupling said driving portion of said lever to said latch spindle so that vertical movement of said driving portion due to pivoting movement of said lever results in rotation of said latch spindle;

a latch assembly including a latch and a latch driving mechanism operatively driven by said latch spindle for extending said latch outwardly to lock the door; and a link assembly including a pull shaft having a first end connected operably to said coupling means of said outside lever mechanism so as to drive rotatably said latch spindle, and a second end; a coupling shaft having a first end connected to said second end of said pull shaft, and intermediate portion mounted pivotally to said housing set, and a second end; and a driving cam connected operably to said outside rotary lock unit for co-rotation with said deadbolt spindle, said driving cam having a camming portion which contacts said second end of said coupling shaft and which drives said coupling shaft to pivot so as to pull said pull shaft and enable said pull shaft to drive rotatably said latch spindle in order to result in simultaneous retraction of said deadbolt and said latch when said outside rotary lock unit is operated to rotate said deadbolt spindle;

wherein said coupling means of said outside lever mechanism comprises a spindle actuator disposed non-rotatably on said latch spindle, an elongated connecting plate having a first end connected to said spindle actuator and a second end connected to said first end of said pull shaft, and an elongated drive plate having a first end mounted pivotally on said housing set and a second end connected to said second end of said connecting plate, said drive plate being disposed above said driving portion of said lever such that vertical movement of said driving portion will result in corresponding movement of said drive plate.

2. The door lock set as claimed in claim 1, wherein said second end of said coupling shaft is formed with a driven stub to be driven by said camming portion of said driving cam.

3. The door lock set as claimed in claim 1, wherein one of said first end of said coupling shaft and said second end of said pull shaft is formed with a mounting hole, the other one of said first end of said coupling shaft and said second end of said pull shaft being formed with a connecting stub that extends into said mounting hole to interconnect pivotally said coupling shaft and said pull shaft.

4. The door lock set as claimed in claim 1, wherein said intermediate portion of said coupling shaft is formed with a through-hole, said link assembly further including a mounting screw which extends through said through-hole of said coupling shaft to mount pivotally said coupling shaft to said housing set.

5. The door lock set as claimed in claim 1, wherein said second end of said coupling shaft is provided with a rotatable roller set to be driven by said camming portion of said driving cam.

6. The door lock set as claimed in claim 1, wherein said intermediate portion of said coupling shaft is formed with a through-hole, said housing set being formed with a mounting stub which has an axial pivot support that extends through said through-hole of said coupling shaft to mount pivotally said coupling shaft to said housing set.

7. The door lock set as claimed in claim 1, wherein said intermediate portion of said coupling shaft is formed with a through-hole, said link assembly further including a mounting screw engaging threadedly said housing set and a support ring inserted through said through-hole of said coupling shaft and formed with a through-hole to permit sleeving of said coupling shaft on said mounting screw to support rotatably said coupling shaft on said mounting screw.

* * * * *